United States Patent [19]
Amsler
[11] 4,010,338
[45] Mar. 1, 1977

[54] VACUUM SWITCH HAVING AXIALLY DISPOSED SWITCHING ELEMENTS

[75] Inventor: Joachim Amsler, Seon, Switzerland
[73] Assignee: Sprecher & Schuh AG, Aarau, Switzerland

[22] Filed: May 29, 1975
[21] Appl. No.: 581,928
[30] Foreign Application Priority Data
June 13, 1974 Switzerland ..... 8114/74
[52] U.S. Cl. ..... 200/144 R; 200/307
[51] Int. Cl.[2] ..... H01H 9/42
[58] Field of Search ..... 200/144 A, 144 B, 144 R, 200/148 C, 148 D, 147 B, 307

[56] References Cited

UNITED STATES PATENTS

| | | | |
|---|---|---|---|
| 3,534,192 | 10/1970 | Miles | 200/144 B |
| 3,866,005 | 2/1975 | Amsler | 200/144 B |
| 3,912,974 | 10/1975 | Hill | 200/144 R |

FOREIGN PATENTS OR APPLICATIONS

| | | | |
|---|---|---|---|
| 740,992 | 8/1966 | Canada | 200/144 B |
| 1,274,926 | 9/1961 | France | 200/144 B |
| 409,056 | 9/1966 | Switzerland | |

*Primary Examiner*—Gerald P. Tolin
*Attorney, Agent, or Firm*—Haseltine, Lake & Waters

[57] ABSTRACT

A vacuum switch having a housing within which there are arranged axially oriented switching elements and fixedly mounted sheet metal or plate electrodes, wherein between the axially aligned sheet metal members thereof there are left free gaps or spaces and the confronting electrode end surfaces or faces of which serve to take-up the base points of the arc. According to the invention, within the switch housing there are arranged a number of sheet metal electrodes in the form of a column with oppositely situated electrode end surfaces and the sheet metal electrodes form compartments within the switch housing which are separated from one another by metallic chip or shaving layers present in the individual sheet metal electrodes, and the separation gap of the switching elements extends through the compartments past the height of the electrode column.

10 Claims, 10 Drawing Figures

VACUUM SWITCH HAVING AXIALLY DISPOSED SWITCHING ELEMENTS

BACKGROUND OF THE INVENTION

The present invention relates to a new and improved construction of a vacuum switch having a switch housing within which there are axially arranged switching elements and fixedly mounted sheet metal electrodes, wherein between the axially aligned sheet metal members of such electrodes there are left free gaps or spaces and the confronting electrode end faces serve to take-up the base points of the arc.

Arc electrodes of the aforementioned type composed of sheet metal have been disclosed in Swiss Pat. No. 528,548 and the Swiss patent of addition 531,784 and, in contrast to conventional ring-shaped, for instance slotted circular tracks arranged at the switching elements, possess the advantage that between two of the same the switching arc also burns in a diffuse manner above approximately 10 kA cut-off current. When carrying out a cut-off operation with arcs, even with scattered or diffused arcs, metallic vapors are formed which must be removed as quickly as possible out of the switching path after extinguishing the arc in order to prevent breakdown of the switching path, for instance with recurrent voltages. In order to re-establish the dielectric state, the metallic vapors are condensed at walls of a switching element in vacuum switches, and to guarantee for sufficiently rapid condensation care must be taken to insure that the condensation surfaces come to lie in close proximity to the vapor outlet locations.

Thus, for instance, in German patent publication No. 1,207,989 there is taught to the art a vacuum switch for alternating currents wherein there is provided at a fixed switching element and at a movable switching element a respective slotted ring-shaped circular track serving as the arc electrode and between the circular tracks of the switching elements there is provided a ring which is slotted at both end faces. In this instance the switching elements are constructed such that the arc, due to magnetic effects, is propelled outwardly to the circular tracks, and the intermediate ring brings about a subdivision of the arc into partial arcs. Owing to the relatively slight spacing of the switching elements from the circular tracks and the intermediate ring as well as the intermediate ring from the circular tracks in this case there are provided favorable conditions for rapid condensation of the metallic vapors distributed over the switching path. In the case of sheet metal or plate electrodes in accordance with the teachings of the aforementioned Swiss patents the condensation of the metallic vapors is particularly good, but even with such sheet metal electrodes small quantities of metallic vapor still can move back into the separation path which, under certain circumstances, can initiate re-ignition of the arc. In order to prevent such there is provided, in addition to the sheet metal members or plates in the arc electrode, a condenser for the condensation of the metallic vapors, as such has been taught for instance in Swiss Pat. No. 554,595, granted Aug. 15, 1974 and the corresponding United States application, Ser. No. 502,396, filed Sept. 3, 1974, and now abandoned, the disclosure of which is incorporated herein by reference. With such constructed vacuum switching element having a vacuum-tight or sealed housing, a fixed switching element mounted at one housing cover and a movable switching element mounted at another housing cover, then each switching element is, for instance, surrounded by an arc electrode consisting of radially directed sheet metal members, wherein such sheet metal members are arranged for instance at a tubular element serving as the electrode support and secured to a housing cover. Further, in this arrangement the internal compartment or space of the tubular element between the housing cover and the electrode sheet metal members is filled with, for instance, metal sponge or metal shavings or chips serving as the condenser. The strict division into switching elements and arc electrodes makes it possible to optimally construct both components in accordance with their function and for the fabrication thereof to use materials (alloys) by means of which there can be extensively prevented welding at the contact elements. Furthermore, at the arc electrodes a rapid extinguishing of the arc is ensured, which as is known cannot be obtained with one material.

In a vacuum switch element the switchable current intensity is essentially governed by the construction of the switching elements and the voltage or electric strength by their separation distance. With increasing separation distance the electric strength (amplitude of the arcing or flashover voltage) does not increase proportionally, rather increases less rapidly, so that already for practical and operational reasons the electric strength of a vacuum switching element cannot be randomly increased. For switching high voltages generally therefore the same switching elements are connected in series and the series switching elements have connected in parallel therewith control elements (resistors, capacitors) in order to uniformly distribute the transient voltage at the individual partial paths. However, such series connection of the switching elements is complicated and unacceptably expensive.

Therefore, as taught, for instance, in Swiss Pat. No. 409,056 a number of contact pairs in the form of a column are arranged in a vacuum-tight housing and for the actuation of the movable contacts there is provided a common ceramic shaft. Further, between the individual contact pairs there are provided sheet metal members forming compartments which only possess one opening for the throughpassage of the ceramic shaft, in order to prevent the passage of metallic vapors from one compartment into the other. To this end there are known different constructional embodiments. Thus, for instance, there are known high voltage-vacuum switches with series arranged contact elements which in the closed position of the switch form a conductive path leading to all contact elements and in the open position of the switch form a series of interruption spaces or compartments, wherein, as taught in German patent publication No. 2,163,900, through the use of screening means which are arranged at the contact elements the interruption compartments are separated from one another and there is prevented the spreading of field lines over more than one interruption compartment. What is disadvantageous with this or similar high voltage-vacuum switches is the fact that the electrodes taking-up the arc base points also serve as contact elements and thus, consistent with the preceding explanations, there cannot be simultaneously realized good extinguishing of the arc and there cannot be rendered more difficult welding of the contact elements or pieces, because the measures necessary to prevent welding impair the characteristics responsible for the extinguishing of the arc. Therefore, under certain circumstances it can happen that a number of contacts weld together, and owing to this possibility there must be available in any case a relatively large drive energy in order to separate the welded contacts. This requires compromise solutions, especially in the case of switches operating with high-currents, and with which there also cannot be eliminated operational disturbances due to welded contacts even with non-optimum extinguishing characteristics, so that the advantage of a short separation path which is attained for the drive of such switches considerably loses in significance.

SUMMARY OF THE INVENTION

Hence with the foregoing in mind it is a primary object of the present invention to provide an improved construction of vacuum switch which is not associated with the aforementioned drawbacks and limitations of the prior art proposals.

Another and more specific object of the present invention is to provide a new and improved construction of a vacuum switch for high cut-off or interruption currents and high voltages which, without the need to resort to compromises as concerns the construction of the switch, possesses both satisfactory extinguishing characteristics with rapid re-establishment of the dielectric state after the extinguishing of the arc as well as also good separation characteristics with considerably reduced danger of contact welding.

Now in order to implement these and still further objects of the invention, which will become more readily apparent as the description proceeds, the vacuum switch of this development is manifested by the features that a number of sheet metal electrodes in the form of a column are arranged in the switch housing and in a formation such that there are present oppositely situated electrode end surfaces or faces. The sheet metal electrodes form compartments or chambers within the switch housing which are separated from one another by metallic chip layers provided in the individual sheet metal electrodes. The separation path of the switching elements extends through the compartments past the height of the electrode column. With these measures there is achieved the beneficial result that the switching elements themselves can be constructed for the weld-free cut-off of an interruption or cut-off current of random predetermined current intensity, and equally the sheet metal electrodes themselves can be constructed for maintaining diffuse arcs which produces the known advantageous result that there is present small electrode burn-off, and rapid reliable extinguishing of such arc. Moreover, for each given voltage amplitude there can be attained the electric strength by providing a sufficient number of compartments in the switch housing, and in any event by virtue of the metallic chip layers separating the compartments from one another there is insured a rapid re-establishment of the dielectric state of the switch after extinguishing the arc. The vacuum switch according to the invention furthermore can be fabricated in a simple and robust construction.

BRIEF DESCRIPTION OF THE DRAWINGS

The invention will be better understood and objects other than those set forth above, will become apparent when consideration is given to the following detailed description thereof. Such description makes reference to the annexed drawings illustrating a number of exemplary embodiments of the invention wherein.

DETAILED DESCRIPTION OF THE INVENTION

Figure 1:
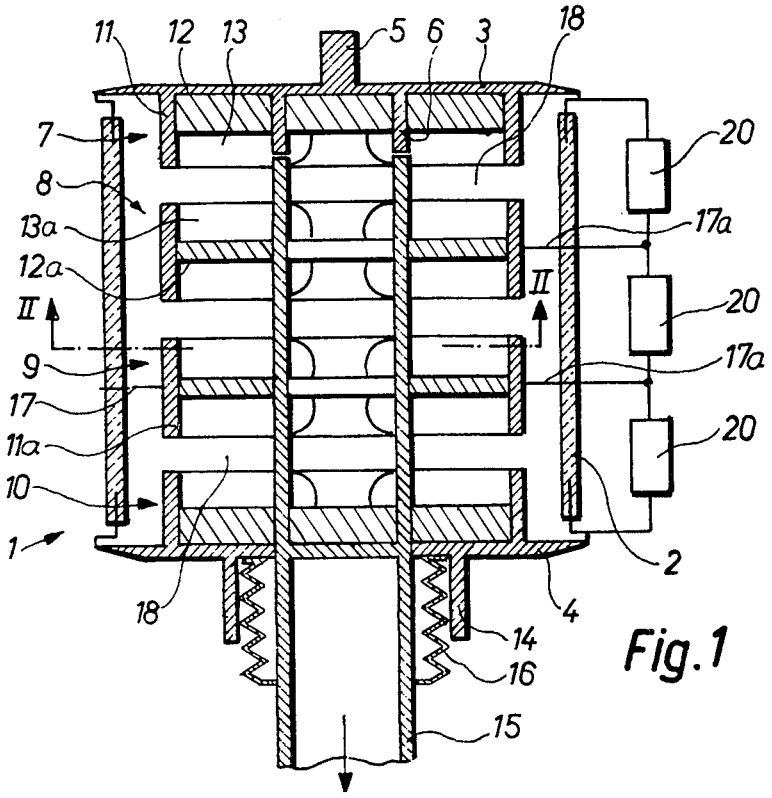
FIG. 1 is a longitudinal sectional view of a vacuum switch designed according to the teachings of the present invention having four sheet metal electrodes and tubular-shaped switching elements or pieces.
Figure 2:
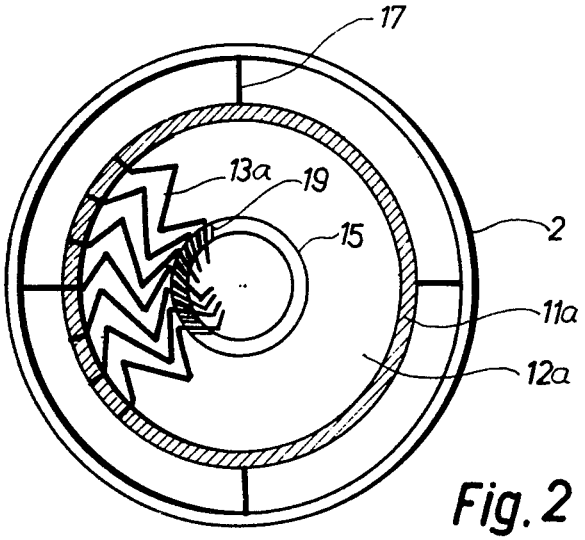
FIG. 2 is a cross-sectional view of the vacuum switch portrayed in FIG. 1, taken substantially along the line II—II thereof.
Figure 1A:
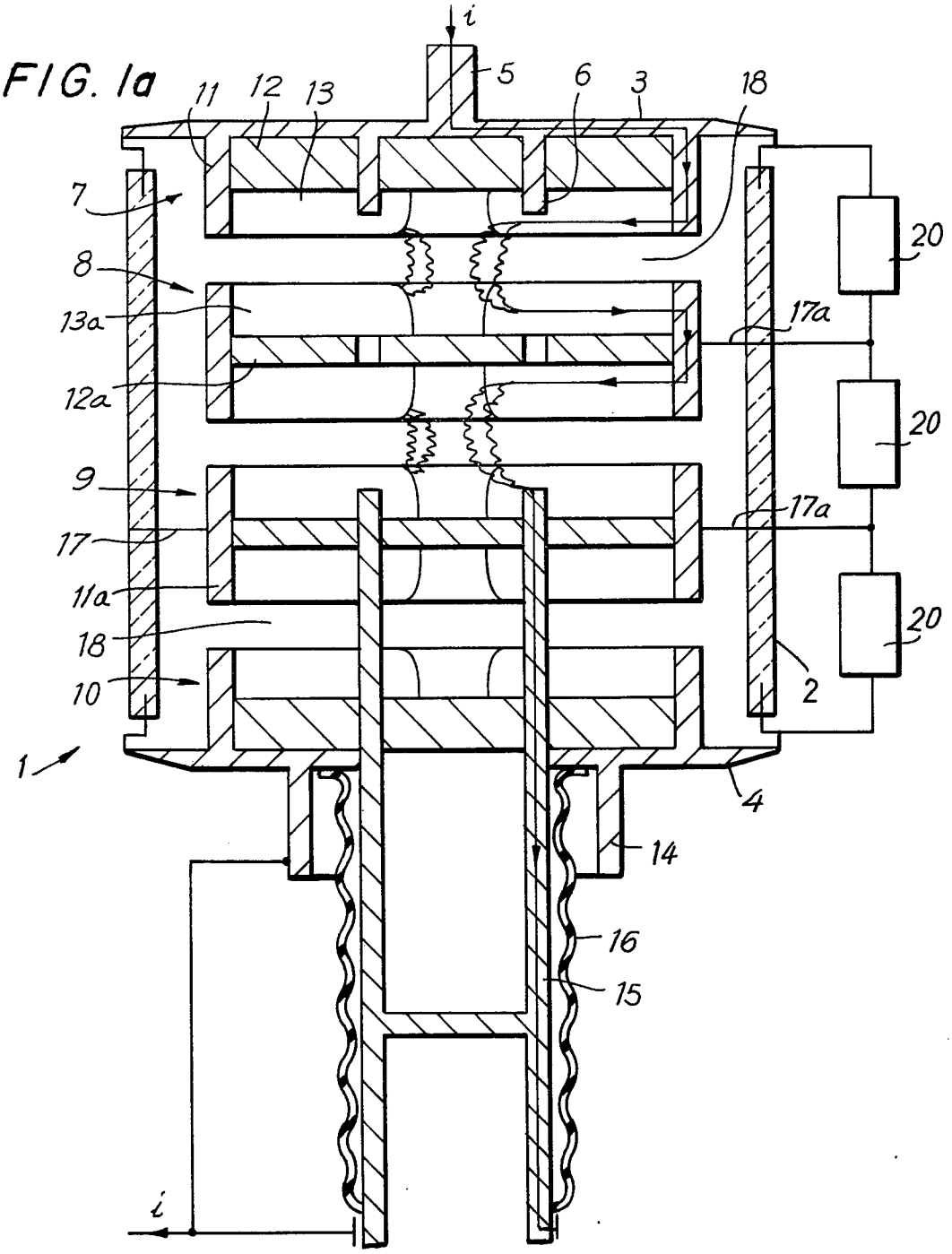
FIG. 1*a* corresponds to FIG. 1, but showing one switch element separated from another switch element.
Figure 1B:
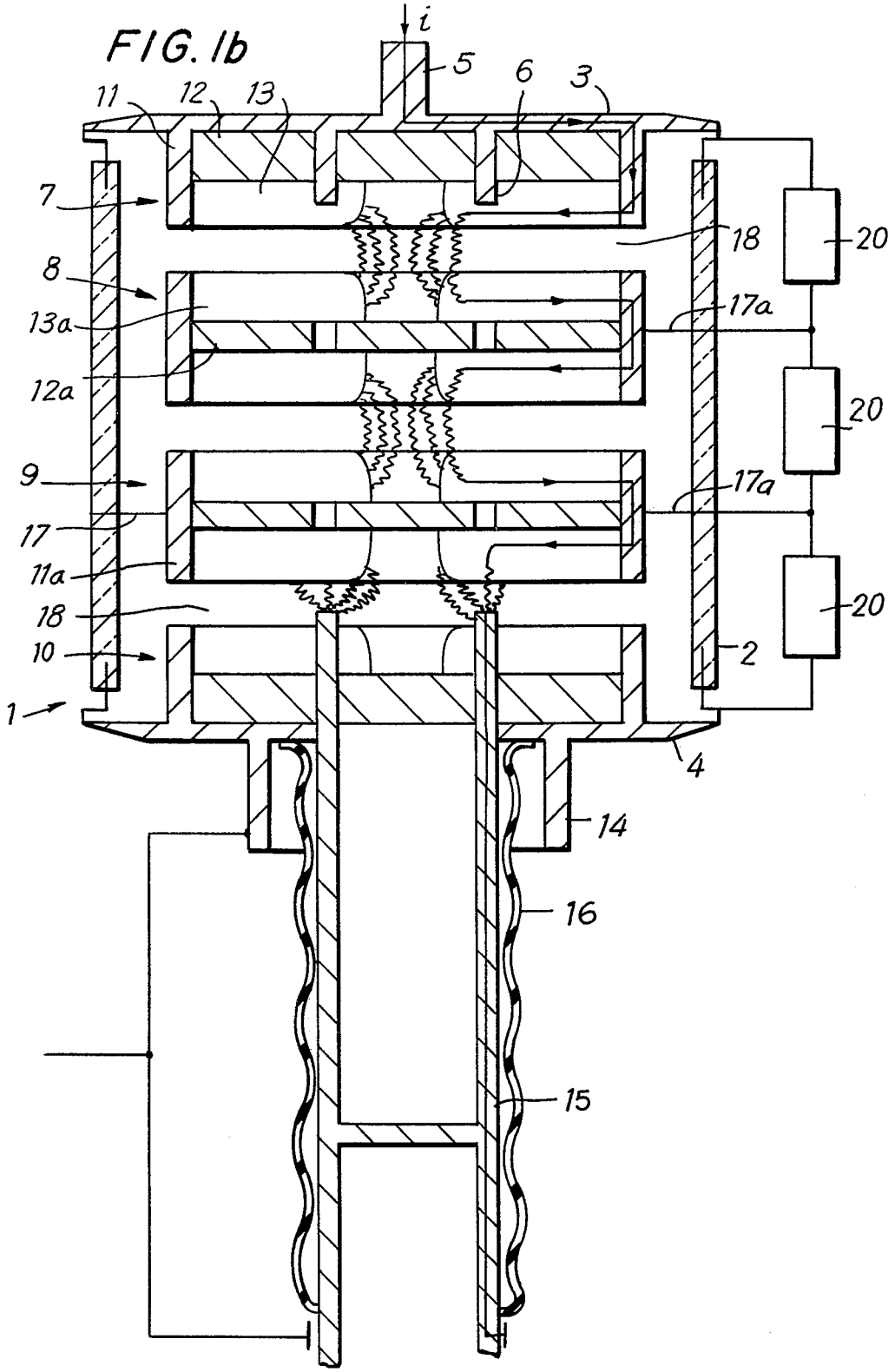
FIG. 1*b* corresponds to FIG. 1*a*, with the one switch element further withdrawn from the other switch element.
Figure 3:
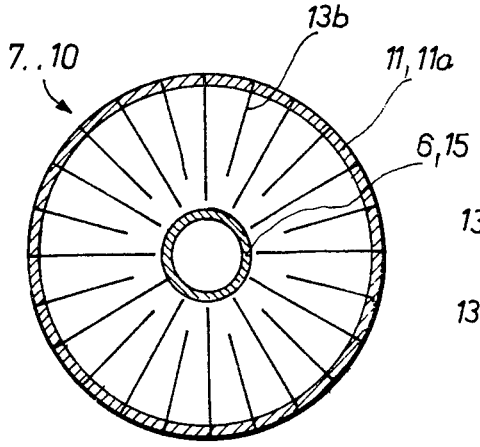
FIG. 3 illustrates an arrangement of sheet metal or plate electrodes with radially extending sheet metal members of such electrodes.

Describing now the drawings, the vacuum switch illustrated in longitudinal sectional view in FIG. 1 and in cross-sectional view in FIG. 2 possesses a vacuum-tight or sealed housing 1 having a substantially cylindrical portion 2 formed of electrically insulating material and both of the metallic covers or cover members 3 and 4. The upper metallic cover 3 shown in the drawings carries at its outside surface a projection 5 for the one switch terminal and at its inner surface a fixed switching or switch element 6 in the form of a short tubular or pipe section. There is provided for the sheet metal or plate electrode 7 — hereinafter such type electrodes will be simply conveniently referred to as the sheet metal electrodes — associated with the fixed switching element or piece 6 at the inside of the metallic cover 3 a tubular-shaped or pipe-shaped electrode support or carrier 11 which concentrically surrounds the switching element or piece 6. Within the electrode support 11 the metallic cover 3 is covered by a metallic chip layer 12 forming a condenser for metallic vapors. The metallic chip layer 12 advantageously consists of degasified copper chips or shavings and is retained by the electrode sheet metal members or plates 13, hereinafter simply referred to as sheet metal members. The electrode sheet metal members 13, for the embodiment presently under discussion, are constituted by radially arranged and zig-zag flexed sheet metal strips, such as the strips 13*a* shown in FIG. 2 which are secured by means of their outer ends in the appropriately slotted electrode support 11 and the inner ends of which extend up to and into the tubular-shaped switching element 6 in which they are likewise held in slots.

The lower metallic cover 4 carries at its outer surface a tubular-shaped projection 14 serving as the second switch terminal or connection. The movable switching or switch element 15 is constructed in the form of a pipe or tube which can be forwardly displaced in the axial direction by any suitable, conventional and therefore not particularly illustrated switch drive for closing the switch until it is in contact with the fixed switching element 6 and for the switch separation operation is retracted from the fixed switch element 6. As is conventional, the movable switching element or piece 15 is held by means of a metallic bellows 16 at the metallic or metal cover 4. At the inside or inner surface of the metallic cover 4 there is arranged a sheet metal electrode 10 which is constructed in the same manner as the sheet metal electrode 7 at the upper metallic cover 3.

Between both of the sheet metal electrodes 7 and 10 mounted at the covers 3 and 4, respectively, there are located within the switch housing 1 additional sheet metal electrodes 8 and 9. These intermediately situated sheet metal electrodes 8, 9 are constructed the same as the already described sheet metal electrodes 7, 10 and each consists of a substantially ring-shaped or annular electrode support 11*a* with the same inner diameter and outer diameter as the electrode supports 11 of the sheet metal electrodes located at the covers. The ring-shaped electrode supports 11*a* are secured, for instance, by means of rings or ring members 17 at the cylindrical housing portion or component 2, and specifically in such a manner that all of the electrode supports in the housing have essentially the same axial spacing from one another and are coaxially oriented. The rings 17 form partition walls between the individual compartments. Each ring-shaped electrode support 11*a* contains electrode sheet metal members 13*a* in the same arrangement and construction as the electrode sheet metal members of the sheet metal electrodes 7 and 10 at the covers 3 and 4, respectively, and in its medial cross-sectional plane also a metallic chip layer 12*a*. In this way the switch housing 1 is subdivided by means of the sheet metal electrodes 7,8,9 and 10 into compartments 18 which are separated from one another by the metallic chip layers 12, 12*a*. The electrode sheet metal members 13, 13*a* of the sheet metal electrodes 7,8,9 and 10 are positionally aligned with one another and the tubular-shaped movable switching element 15 contains longitudinal or lengthwise slots 19 (FIG. 2) in which, during forward movement and retraction of such switching element, there can slide the inner ends of the electrode sheet metal members. The radial rings or ring members 17 holding the intermediate sheet metal electrodes 8, 9 are formed as lead-in wires or ducts 17*a* and, as is conventional in this art, between the switch terminals and the lead-in wires 17*a* there are connected the control elements 20 of the vacuum switch, so that the build-up or transient voltage is uniformly distributed at all sheet metal electrodes.

The switching elements or pieces 6 and 15, without taking into consideration the extinguishing characteristics or properties, can be fabricated from a contact material which poorly welds and is dimensioned for switching a certain current intensity. As the material for the switching elements there can be used to advantage, for instance, copper containing small quantities of bismuth, beryllium, lead or tin.

Upon separation of the switching elements 6 and 15 there initially appears in the first compartment 18 at the fixed or immobile switching element or piece 6 a substantially ring-shaped arc which, under the action of the self-magnetic field commutates to the sheet metal electrodes 7 and 8, commutation occurring very rapidly and in an extremely positive manner owing to the electrode sheet metal members or plates 13, 13*a* which protrude with their ends into the tubular-shaped switching element. The sheet metal electrodes 7,8,9 and 10 are constructed independently of the switching elements or pieces 6, 15 for rapid and reliable extinguishing of the arc. To this end the sheet metal members are advantageously fabricated from iron, nickel, chromium-nickel, molybdenum, tantalum or tungsten. During further retraction of the movable switching element 15 the arc is extinguished in the second or next compartment between the sheet metal electrodes 8 and 9 and finally in the third compartment between the sheet metal electrodes 9 and 10. Due to the provision of the metallic chip layers 12*a* no metallic vapors can migrate from one compartment into the other, so that after extinguishing of the arc there is rapidly re-established the dielectric state in the compartment and there does not occur any mutual influencing of the individual compartments. With the zig-zag shaped and flexed electrode sheet metal members 13*a* illustrated in FIG. 2 there is realized the advantageous result that metallic droplets which are propelled away remain adhering to the inclined regions of the sheet metal members.

As far as the switching elements and sheet metal electrodes are concerned different constructional embodiments are possible. To that end in FIGS. 3 to 7 there are shown further exemplary embodiments, wherein in each case there is schematically illustrated in sectional plan view one sheet metal electrode.

With the exemplary embodiment depicted in FIG. 3 there are again utilized pipe- or tubular-shaped switching elements 6 and 15. The sheet metal electrodes 7,8,9,10 contain substantially flat, radially extending sheet metal members or plates 13*b* — it again being called to mind that for all embodiments disclosed herein the same shall be simply conveniently referred to as sheet metal members — which only extend into close proximity with respect to the switching elements.

Figure 4:
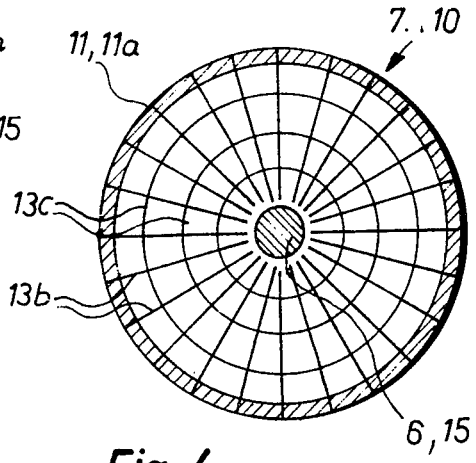
FIG. 4 illustrates a further arrangement of radially extending sheet metal members or plates of sheet metal electrodes.

FIG. 4 illustrates variant construction of a sheet metal electrode having a honeycomb-like constructed sheet metal arrangement composed of substantially flat, radially extending sheet metal members 13*b* and substantially circular-shaped, flexed concentrically arranged sheet metal members 13*c*, wherein these sheet metal members 13*b*, 13*c* are interleaved or inserted in a comb-like fashion into one another. The switching or switch elements 6 and 15 in this instance are, for instance, in the form of substantially circular rods.

Figure 5:
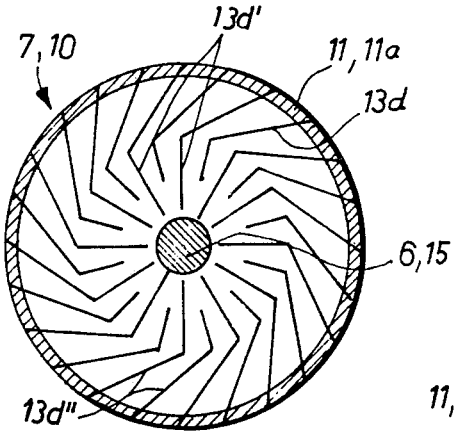
FIG. 5 illustrates a still further arrangement of radially extending sheet metal members or plates of sheet metal electrodes.

Continuing, in the exemplary embodiment depicted in FIG. 5 the sheet metal electrodes contain electrode sheet metal members 13*d* which are flexed once and having radially directed inner portions 13*d'* and outer portions 13*d''* extending at an inclination thereto. As the switching or switch elements there are again used substantially circular rods or bars 6, 15.

Figure 6:
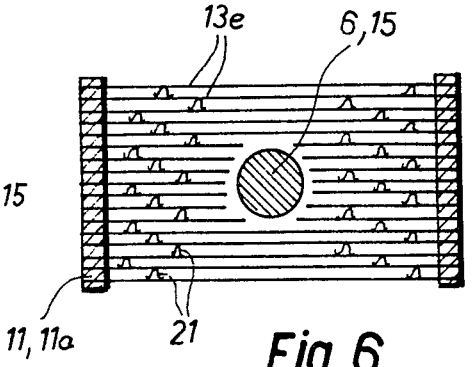
FIG. 6 illustrates an arrangement of parallelly oriented sheet metal members or plates of sheet metal electrodes.

A sheet metal electrode construction with substantially flat or planar parallelly oriented electrode sheet metal members 13*e* has been shown in FIG. 6. In order to insure that there will be present a desired spacing between the individual sheet metal members 13*e* there can be provided thereat the depicted impressions or indentations 21 defining protuberances which in each case then bear against the neighboring sheet metal member 13*e*.

Figure 7:
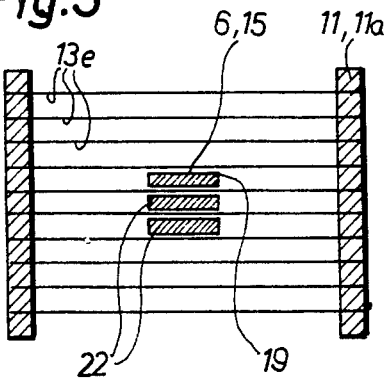
FIG. 7 illustrates a further arrangement of parallelly oriented sheet metal members or plates of sheet metal electrodes.

Instead of using circular switch or switching elements in the vacuum switch there can be also employed substantially flat switching elements or pieces. FIG. 7 illustrates a corresponding exemplary embodiment containing sheet metal electrodes having substantially flat parallel sheet metal members 13*e* and substantially flat switching elements or pieces 6, 15, the ends of which possess substantially parallel tongues or flaps 22 or the like formed by longitudinal slots 19 and such tongues 22 are located between the sheet metal members 13*e*.

Figure 8:
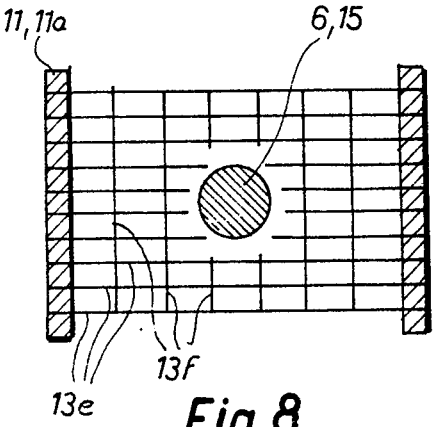
FIG. 8 illustrates another arrangement of parallelly oriented sheet metal members or plates of sheet metal electrodes.

Finally, as best seen by referring to FIG. 8 the sheet metal electrodes also can be constructed in a honeycomb-like manner with substantially flat parallel sheet metal members 13*e*. Such sheet metal electrodes 13*e* additionally are provided with a second set of substantially parallel sheet metal members 13*f* which are disposed perpendicular to the sheet metal members 13*e* of the first set, and wherein the sheet metal members 13*e* and 13*f* of both sets are mutually inserted into one another or interleaved in a substantially comb-like manner for instance. Such honeycomb-like structures can be easily fabricated and are inherently very stable, so that they can be easily inserted into their electrode support. Moreover, at each sheet metal electrode the respective previously discussed metallic chip or shaving layer can be arranged between two such honeycomb-shaped or honeycomb-like sheet metal structures. While there is shown and described present preferred embodiments of the invention, it is to be distinctly understood, that the invention is not limited thereto, but may be otherwise variously embodied and practiced within the scope of the following claims.

What is claimed is:

1. A vacuum switch comprising a switch housing having a central axis, switching elements substantially axially arranged in said switch housing, a number of individual sheet metal electrodes fixedly mounted on said switch housing, said sheet metal electrodes incorporating a plurality of substantially radially directed sheet metal members extending radially inwardly along said electrodes towards the central axis of the housing there being formed a set of gaps between the latter, respectively, said sheet metal electrodes including electrode end-surfaces confronting one another and serving to take up base points of an arc formable therebetween, said sheet metal electrodes being arranged in said switch housing in the form of a column with the electrode end surfaces situated opposite one another, respectively, there being formed a separation gap between said sheet metal electrodes, metallic chip layers being provided at the individual sheet metal electrodes, said switching elements including engageable contacts, at least one of said contacts being fixedly mounted, the other of said contacts being movable, said switching elements forming a separation gap extending within the height of the electrode column.

2. The vacuum switch as defined in claim 1, wherein the sheet metal members of the sheet metal electrodes are extended substantially radially with respect to the lengthwise axis of the switching elements.

3. The vacuum switch as defined in claim 2, wherein each of the sheet metal electrodes contains in addition to the radially extending sheet metal members substantially circular-shaped sheet metal members which are substantially concentrically arranged with respect to the lengthwise axis of the switching elements, said radially extending sheet metal members and said circular-shaped sheet metal members conjointly forming at each sheet metal electrode a substantially honeycomb-like structure.

4. The vacuum switch as defined in claim 1, wherein the sheet metal members of the sheet metal electrodes are arranged substantially parallel to one another.

5. The vacuum switch as defined in claim 4, further comprising additional sheet metal members intersecting said substantially parallelly arranged sheet metal members, said additional sheet metal members being disposed essentially in parallel with one another and together with the first-mentioned parallelly arranged sheet metal members forming at each sheet metal electrode a substantially honeycomb-like structure.

6. The vacuum switch as defined in claim 1, wherein said switching elements comprise substantially circular rods.

7. The vacuum switch as defined in claim 1, wherein said switching elements are constituted by substantially tubular-shaped members.

8. The vacuum switch as defined in claim 7, wherein said tubular members are formed with parallel slots, said sheet metal members extending therethrough.

9. The vacuum switch as defined in claim 1, wherein the switching elements are constituted by substantially flat switching elements, and wherein the movable contact is disposed between the sheet metal members of the sheet metal electrodes located within the separation gap.

10. The vacuum switch as defined in claim 1, wherein said switch housing includes a metallic cover and an electrically insulated portion, the sheet metal electrodes comprise a first sheet metal electrode and a last sheet metal electrode and intermediately disposed sheet metal electrodes located therebetween, the first and the last sheet metal electrodes of the electrode column each being connected to said metallic cover of the switch housing, the intermediately disposed sheet metal electrodes being connected to the electrically insulated housing portion of the switch housing and supporting said metallic cover, said first sheet metal electrode of the electrode column containing the fixed contact, and the movable contact being retractable away from said first sheet metal electrode up to the last sheet metal electrode of the electrode column.

* * * * *